United States Patent [19]

Bouthillier

[11] 4,368,772

[45] Jan. 18, 1983

[54] SECTIONAL DOOR PANEL

[76] Inventor: Louis Bouthillier, 2170 Bellerive Blvd., Carignan, Quebec, Canada, J3L 3P9

[21] Appl. No.: 187,782

[22] Filed: Sep. 16, 1980

[51] Int. Cl.[3] ..... E06B 9/00; E06B 3/12

[52] U.S. Cl. ..... 160/232

[58] Field of Search ..... 49/501; 160/232, 235, 160/236, 229 R, 229 B

[56] References Cited

U.S. PATENT DOCUMENTS

| | | | |
|---|---|---|---|
| 1,352,656 | 9/1920 | Cahill | 160/232 |
| 1,827,718 | 10/1931 | Whitney | 160/236 |
| 1,910,047 | 5/1933 | Passoni | 160/220 |
| 2,862,256 | 12/1958 | Stroup | 160/229 R |
| 3,540,154 | 11/1970 | Claudio | 160/236 |
| 3,750,333 | 8/1973 | Vance | 49/501 |
| 3,941,180 | 3/1976 | Thill . | |
| 3,967,671 | 7/1976 | Stanley et al. . | |
| 4,119,133 | 10/1978 | Wolf . | |
| 4,156,448 | 5/1979 | Bengtsson | 160/232 |
| 4,179,790 | 12/1979 | Tornerfelt | 49/501 |

*Primary Examiner*—Price C. Faw, Jr.
*Assistant Examiner*—Cherney S. Lieberman
*Attorney, Agent, or Firm*—Raymond A. Robic; Thierry Orlhac; Arthur Schwartz

[57] ABSTRACT

A panel for use in a sectional door. The panel which is easy to construct and has improved insulating properties, has an elongated insulating core, a first metallic skin on one face of the core and a second metallic skin on the other face of the core. The first and second metallic skins both have crimped edges that are joined together at the sides of the panel with an insulating member interposed between them. The insulating members on the long sides of the panel may include diverging seal arms projecting outwards for providing a seal between adjacent panels. The invention is also directed toward a sectional door incorporating the panels.

8 Claims, 3 Drawing Figures

FIG. 1
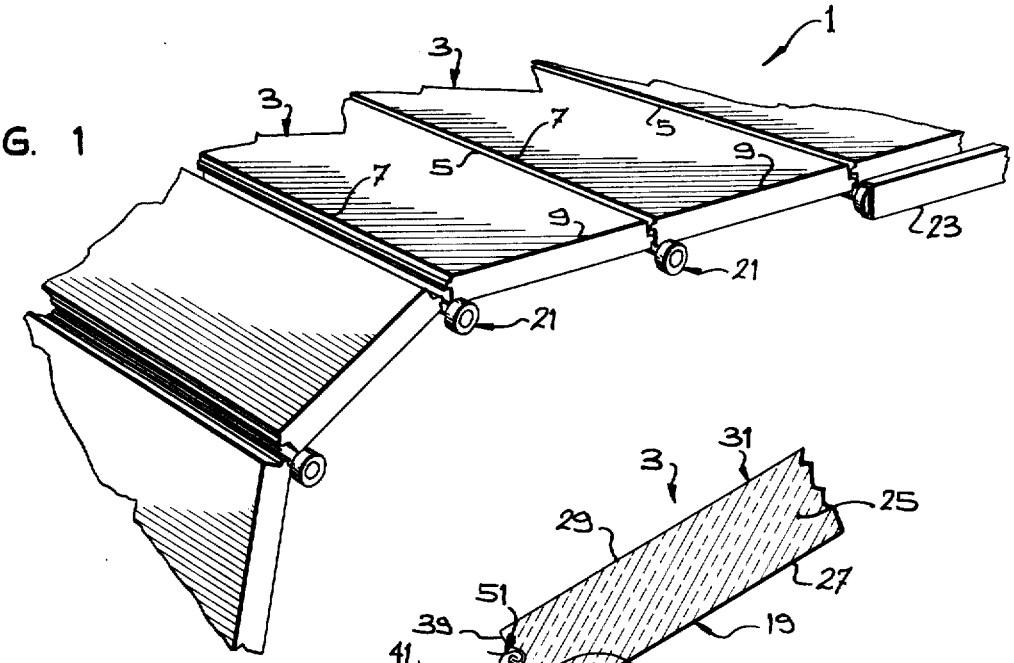
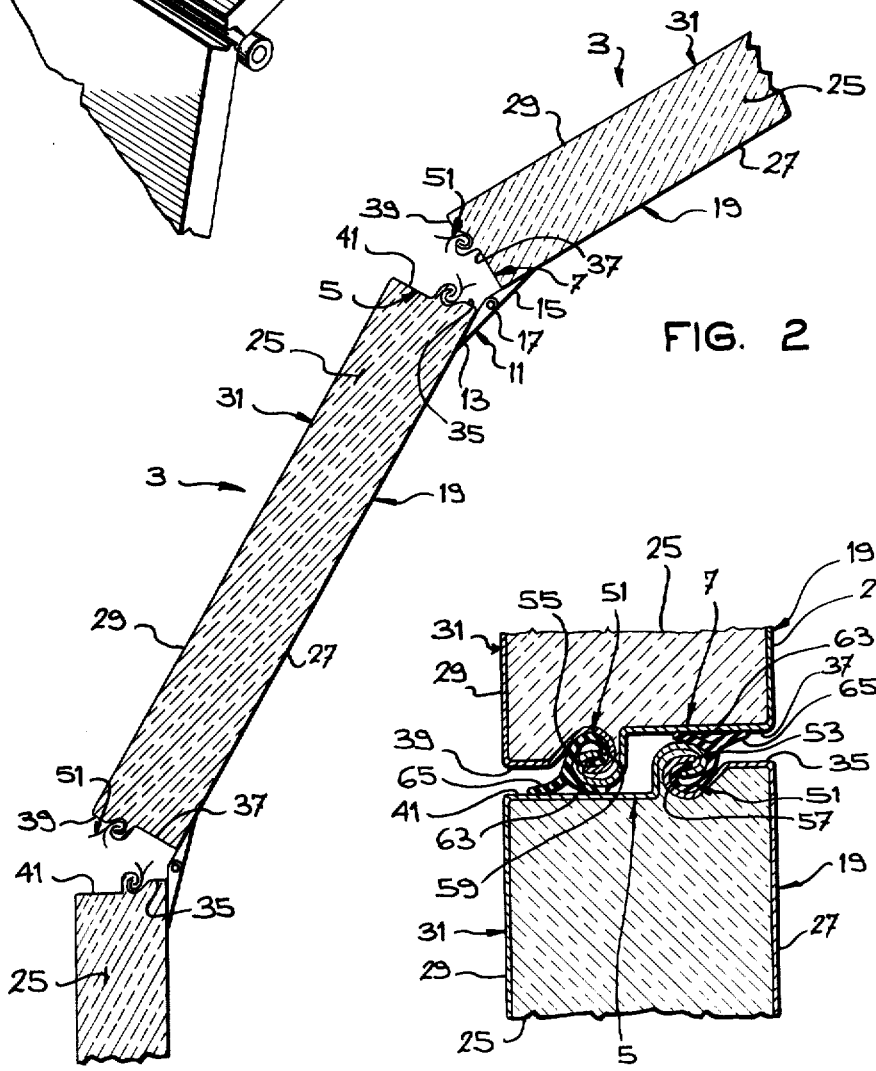
FIG. 2
FIG. 3

SECTIONAL DOOR PANEL

BACKGROUND OF THE INVENTION

1. Field of the Invention

The present invention relates to an improved panel for a sectional door.

The invention also relates to an improved sectional door incorporating the improved panels.

2. Relevant Art

Sectional doors are well known. They comprise a plurality of identical, elongated panels which panels are hinged together along their long sides. The doors can be moved between two positions about a curve and are commonly used to close openings in garages. To open a garage, the door is raised from a closed, vertical position about curved tracks to an open, horizontal position. Examples of such doors are shown in U.S. Pat. Nos. 2,880,796; 3,941,180; 3,967,671 and 4,119,133.

The panels in the sectional door are often composed of a central core of insulating material covered with a metallic skin. Such panels provide a door which is strong, yet light in weight, and which has some insulating properties. The central insulating core often comprises a plastic foam material expanded in place within the metallic covering skin. U.S. Pat. Nos. 2,880,796 and 4,119,133 disclose panels of the above type by way of example.

Sealing means are usually provided between the panels to seal the door tightly in its operative position. The sealing means often comprise separate sealing strips fixed to the long sides of the panels. U.S. Pat. No. 4,119,133 shows such sealing strips by way of example.

The doors made from panels consisting of an insulating core covered with a metallic skin are not as efficient in insulating as they could be. Indeed, heat from within the closed garage is conducted to the outside by the metallic skin covering the insulating core. This heat loss can be considerable.

To obviate this problem, it has already been proposed to insert insulating segments between a pair of metallic skins covering each side of the core. U.S. Pat. Nos. 3,750,333; 3,837,134; 3,599,703 are illustrative in this regard. However, such a solution substantially increases the cost of construction of the panels as it requires additional parts to stock and additional time for the assembling operation.

OBJECTS OF THE INVENTION

It is therefore one object of the present invention to provide an improved door panel of the above type which is at least as much insulated as the already known door panels but easier to construct and assemble.

It is another object of the present invention to provide an improved door panel of the above type which comprises a minimal number of pieces while incorporating sealing means to improve its insulating characteristics.

SUMMARY OF THE INVENTION

In accordance with the present invention, the above objects are achieved by thermally insulating the inner metallic skin of the door panel from the outer metallic skin by inserting and crimping a deformable insulating element therebetween. The inner and outer metallic skins are effectively insulated from each other at the sides of the panel by the insulating member which extends between the crimped edges of the skins.

Preferably the insulating member provided between the edges of the skins includes sealing means projecting from it which sealing means are used to seal the space between adjacent panels in a door. Thus a single member provides both a thermal barrier between the inner and outer metallic skins at their point of connection, and sealing means between adjacent panels.

The invention is particularly directed toward a panel for use in a sectional door, which panel comprises: an elongated insulating core; a first metallic skin on one face of the insulating core the first skin having crimped upper and lower edges; a second metallic skin on the other face of the insulating core, the second skin also having crimped upper and lower edges, and an insulating deformable element inserted at the upper and lower sides of the core between the first and second metallic skins to prevent the skins from touching and thus to minimize heat conduction between the same, the first skin being connected to the second skin by engagement of their respective crimped edges with the insulating element between the edges.

The first and second metallic skins are connected together at the sides of the panel with an insulating member provided between them to prevent them from touching. Preferably, the insulating members on the long sides of the panel have projecting sealing means for use in abutting on an adjacent panel when the panels are employed in a sectional door.

BRIEF DESCRIPTION OF THE DRAWINGS

The invention will be better understood with reference to the following non-restrictive description of an embodiment thereof, taken in connection with the accompanying drawings in which:

FIG. 1 is a perspective view of a portion of a sectional door;

FIG. 2 is a side elevation view of a portion of the sectional door shown in FIG. 1; and FIG. 3 is a detail cross-sectional view of the same door.

DETAILED DESCRIPTION OF THE DRAWINGS AND PREFERRED EMBODIMENTS

The sectional door 1 illustrated in the drawings comprises a plurality of identical, elongated sections or panels 3. Each panel 3 has a pair of parallel long sides 5 and 7 and short sides 9 extending transversely to, and joining, the long sides 5 and 7 at their ends. The panels 3 are arranged with the long side 5 of each panel adjacent the long side 7 of an adjacent panel. The short sides 9 of the panels 3 are aligned.

Hinges 11 connect adjacent panels 3 together. Each hinge 11 has a pair of arms 13 and 15 joined by a hinge pin 17. One arm 13 of each hinge 11 is fastened to one panel 3 on its inner face 19 adjacent one long side 5. The other arm 15 is fastened to the adjacent panel 3 on its inner face 19 adjacent its one long side 7.

Rollers 21 are provided on each side of the door 1 adjacent the short sides 9 of the panels 3. Two rollers 21 are provided between each pair of adjacent panels 3, one on each side of the door. The rollers 21 can be mounted on the hinges 11 with their axes concentric with the hinge axis. The rollers 21 run in a curved track 23 to guide the sectional door 1 in a curved path as it moves between a closed position and an open position.

In more detail, each door panel 3 has a central insulating core 25. This core can be made from suitable insulating material such as a polystyrene foam material expanded in place between an inner metallic skin 27 and an outer metallic skin 29. The inner skin 27 provides the inner face 19 of each panel 3 while the outer skin 29 provides the outer face 31 of the panel.

The inner skin 27 has a short side portion 35 and a long side portion 37. The outer skin 29 also has a short side portion 39 and a long side portion 41. The short and long portions 35 and 41 of the skins 27 and 29 respectively are joined to provide one long side 5 of the panel 3. The other long and short portions 37 and 39 of the skins 27 and 29 respectively are joined to provide the other long side 7 of the panel 3.

In accordance with the present invention, the inner and outer skins 27 and 29 are joined at the long sides 5 and 7 of each panel 3 without touching. To obtain this result, an insulating member 51 is provided between the end portions of the inner and outer skins 27 and 29 at each side 5 and 7 so that they do not contact each other when crimped together. The insulating member 51 advantageously consists of a curved strip of suitable thermoplastic material.

The ends 53 and 55 of the short side portions 35 and 39 of the inner and outer skins 27 and 29 respectively are crimped back toward themselves to form an open loop or hook as shown in FIG. 3. The ends 57 and 59 of the long side portions 41 and 37 are also crimped to form an open loop or hook. The openings of the open loops formed in the ends 57, 59 hook over the ends 53 and 55 of the short side portions 35 and 39. As shown in FIG. 3, in the preferred embodiment, the openings of the open loops formed in the ends 53, 55 also hook over the ends 57, 59 of the long side portions 41 and 37. Preferably, one insulating member 51 is positioned between the hooked over ends 53 and 57 at one side 5 of the panel 3 while another member 51 is positioned between the hooked over ends 55 and 59 at the other side 7 of the panel 3. At the one side 5 of the panel 3 the insulating member 51 is located adjacent the inner face 19 of the panel. At the other side 7 of the panel 3, the insulating member 51 is located adjacent the outer face 31 of the panel 3.

As can be understood, the inner and outer metallic skins 27 and 29 are joined together by their respective crimping at the short sides 9 of the panels, without touching. The skins 27 and 29 can be joined at the short sides 9 in the same general manner as at the long sides 5 and 7 by incorporation of insulating members 51 (not shown) between them.

Means are provided for effecting a seal between adjacent panels 3. Advantageously, these sealing means are constituted by an extension of the insulating members 51 on the long sides 5 and 7 of the panel. This extension projects from between the crimped side portions of the metallic skins and is formed into a pair of diverging legs 63 and 65. The sealing legs 63 and 65 of each insulating member 51 on the long sides on each panel 3 bear against either of the long side portions 37 and 41 of the adjacent panels 3. Because each insulating member 51 in the long side 5 or 7 of the panel 3 is offset from one face or the other of the panel due to the difference in length between the side portions of the inner and outer skins, two seals are provided, side-by-side, at each location between adjacent panels as shown in FIG. 3. The insulating members 51 used on the short sides 9 of the panels 3 do not need sealing means.

I claim:

1. A panel for use in a sectional door, said panel comprising:

an elongated insulating core having a pair of faces and upper and lower sides;

a first metallic skin on one face of said insulating core, said first skin having upper and lower ends crimped back towards themselves to form a first pair of open loops opening toward said first skin;

a second metallic skin on the other face of said insulating core, said second skin having upper and lower ends crimped to form a second pair of open loops opening toward said second skin; and an insulating deformable element inserted at said upper and lower sides of said core between said first and second metallic skins to prevent said skins from touching and thus to minimize heat conduction between the same, wherein said first skin is connected to said second skin by hooking said ends of said first pair of open loops into the opening of said second pair of open loops with said insulating element positioned between said ends of said first and second pairs of loops.

2. A panel as claimed in claim 1, wherein the first and second metallic skins are connected together both at one long side of the core adjacent one face of said core, and at the other long side of the core adjacent the other face of said core.

3. A panel as claimed in claim 2, wherein each insulation element on the long sides of the panel has sealing means projecting from one end outwardly of the long side of the core.

4. A panel as claimed in claim 3, wherein said sealing means comprises a pair of diverging sealing arms projecting form the external end of the insulation element outwardly of the long side of the core.

5. A sectional door comprising a plurality of elongate panels hingedly connected together at their long side, each of said panels comprising:

an elongated insulating core having a pair of faces and upper and lower sides;

a first metallic skin on one face of said insulating core, said first skin having upper and lower ends crimped back towards themselves to form a first pair of open loops opening toward said first skin;

a second metallic skin on the other face of said insulating core, said second skin having upper and lower ends crimped back towards themselves to form a second pair of open loops opening toward said second skin; and an insulating deformable element inserted at said upper and lower sides of said core between said first and second metallic skins to prevent said skins from touching and thus to minimize heat conduction between the same, wherein said first skin is connected to said second skin by said ends of said first pair of open loops being hooked into the opening of said second pair of open loops with said insulating element positioned between said ends of said first and second pairs of loops.

6. A sectional door as claimed in claim 5, wherein the first and second metallic skins of each panel are connected together at one long side of the core adjacent the one face of the core, and at the other long side of the core adjacent the other face of the core.

7. A sectional door as claimed in claim 6, wherein each insulation element on the long sides of the panel has sealing means projecting from one end outwardly of the long side of the panel to abut the long side of an adjacent panel when the door is closed, said sealing means including a pair of diverging sealing arms projecting from the external end of each insulation element.

8. A panel as claimed in claims 1 or 5, wherein each insulation element has means for sealing against an adjacent panel projecting from one end thereof outwardly of the long side of the core.

* * * * *